US009979124B2

(12) United States Patent
Wang

(10) Patent No.: US 9,979,124 B2
(45) Date of Patent: May 22, 2018

(54) PLUG-SECURING CONNECTING APPARATUS AND SOCKET

(71) Applicant: Chia-Peng Wang, New Taipei (TW)

(72) Inventor: Chia-Peng Wang, New Taipei (TW)

(73) Assignee: HONGFUJIN PRECISION ELECTRONICS (TIANJIN) C, Tianjin (CN)

( * ) Notice: Subject to any disclaimer, the term of this patent is extended or adjusted under 35 U.S.C. 154(b) by 0 days. days.

(21) Appl. No.: 15/382,809

(22) Filed: Dec. 19, 2016

(65) Prior Publication Data

US 2018/0102607 A1 Apr. 12, 2018

(30) Foreign Application Priority Data

Oct. 10, 2016 (CN) ..... 2016 1 0881968

(51) Int. Cl.

| | |
|---|---|
| ***H01R 13/625*** | (2006.01) |
| ***H01R 13/627*** | (2006.01) |
| ***H01R 13/74*** | (2006.01) |
| ***H01R 25/00*** | (2006.01) |

(52) U.S. Cl.

CPC ..... *H01R 13/6273* (2013.01); *H01R 13/743* (2013.01); *H01R 25/006* (2013.01)

(58) Field of Classification Search

CPC ..... H01R 13/6275; H01R 25/003; H01R 13/7175; H01R 33/09

USPC ..... 439/345, 214, 490, 375

See application file for complete search history.

(56) References Cited

U.S. PATENT DOCUMENTS

| | | | | |
|---|---|---|---|---|
| 3,434,098 | A * | 3/1969 | Schumacher | H01R 31/00 439/358 |
| 3,829,821 | A * | 8/1974 | Derr | H01R 13/514 439/304 |
| 5,727,963 | A * | 3/1998 | LeMaster | A47C 11/02 439/358 |
| 2008/0076291 | A1* | 3/2008 | Ewing | H01R 13/5812 439/373 |

* cited by examiner

*Primary Examiner* — Phuong Chi T Nguyen

(74) *Attorney, Agent, or Firm* — ScienBiziP, P.C.

(57) ABSTRACT

An electrical socket with a security fixing includes a base and a number of terminal portions. The base includes an inserting side. The inserting side defines a number of receiving grooves. The terminal portions are fixed in the receiving grooves to conduct electricity to a plug. Two clamping members are protruded from the inserting side and when the plug is inserted into the terminal portion, the two clamping members latch onto the plug to hold it in place.

9 Claims, 4 Drawing Sheets

PLUG-SECURING CONNECTING APPARATUS AND SOCKET

CROSS-REFERENCE TO RELATED APPLICATIONS

This application claims priority to Chinese Patent Application No. 201610881968.9, filed on Oct. 10, 2016, the contents of which are incorporated by reference herein.

FIELD

The subject matter herein generally relates to connecting apparatus, especially relates to a connecting apparatus including a socket.

BACKGROUND

Servers are provided with a number of sockets to provide different power supplies. A number of plugs are inserted into the sockets. When a cable connected to the plug is strained, the plug can be pulled out of the socket. Thus, the server is powered off.

BRIEF DESCRIPTION OF THE DRAWINGS

Implementations of the present technology will now be described, by way of example only, with reference to the attached figures.

DETAILED DESCRIPTION

Figure 1:
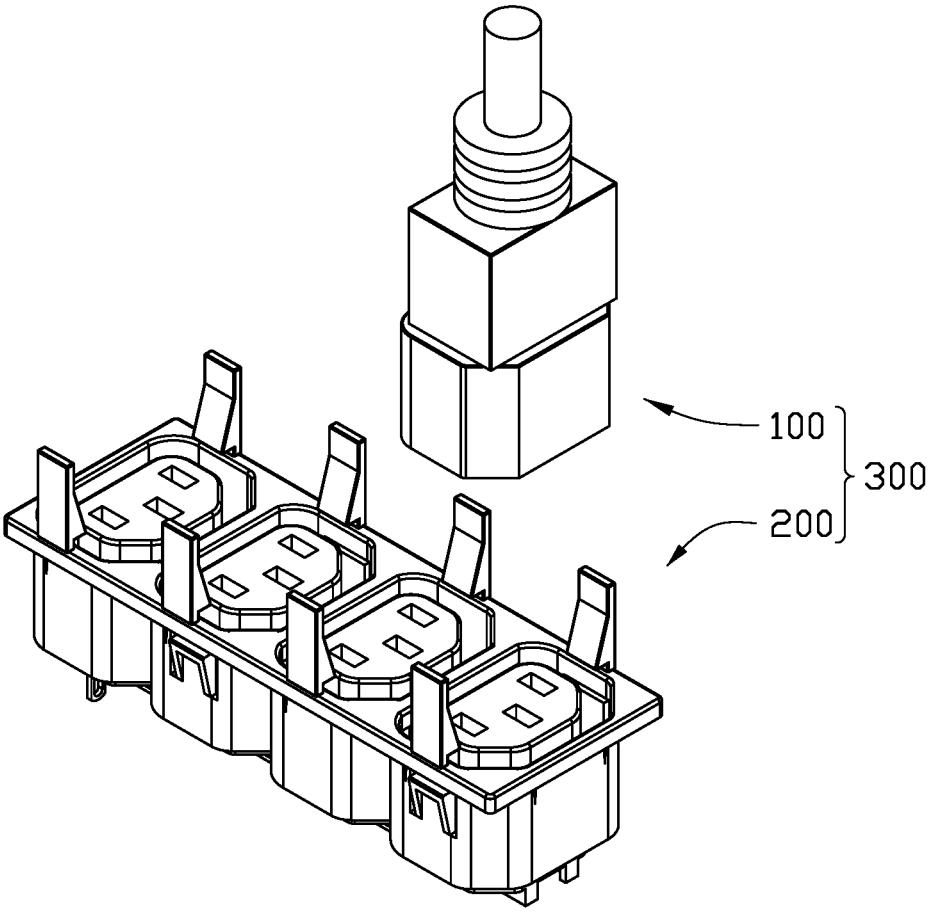
FIG. 1 is an exploded view of a connecting apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like.

FIG. 1 illustrates a connecting apparatus 300. The connecting apparatus 300 includes a number of plugs 100 and a socket 200. The plug 100 is pluggable into the socket 200.

Figure 2:
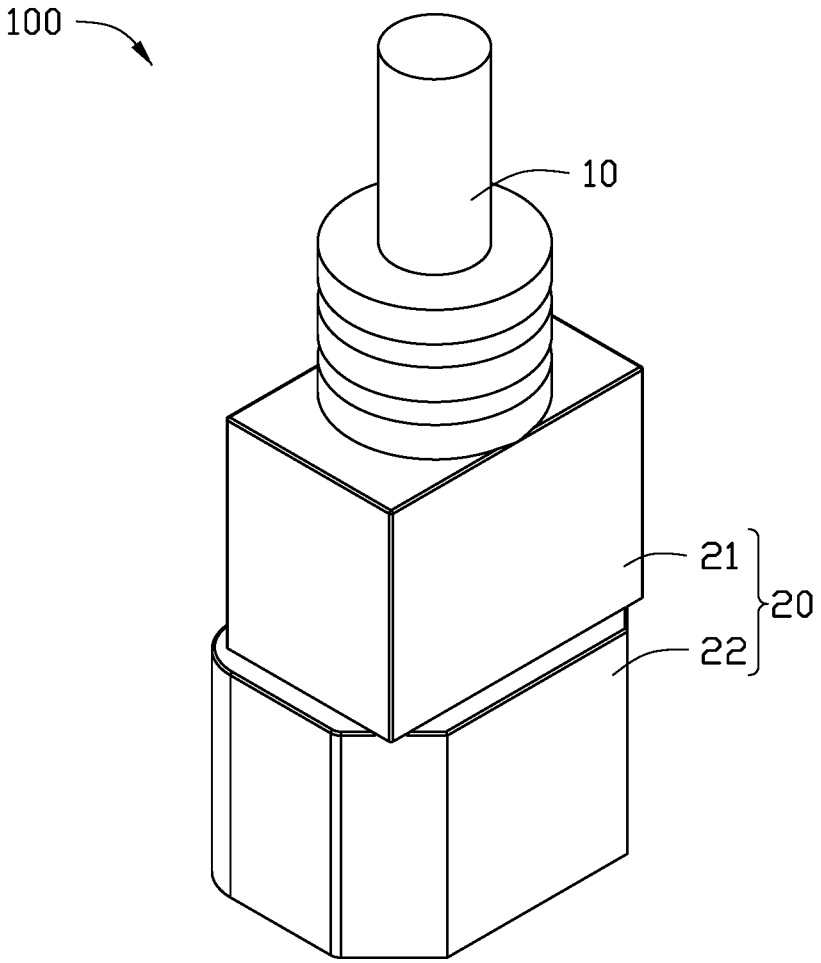
FIG. 2 is an isometric view of a plug for the connecting apparatus in FIG. 1.

FIG. 2 illustrates the plug 100 including a cable 10 and a main body 20. The main body 20 connects to one end of the cable 10. The main body 20 is made of an insulating material. The main body 20 includes a fixing portion 21 and a connecting portion 22. The connecting portion 22 extends from an end of the fixing portion away from the cable 10. An extending direction of the connecting portion 22 is same as an inserting direction of the plug 100 being inserted into the socket 200. The fixing portion 21 is substantially a cuboid. An area of a cross section of the connecting portion 22 perpendicular to the extending direction has an area larger than an area of a cross section of the fixing portion 21 perpendicular to the extending direction.

Figure 3:
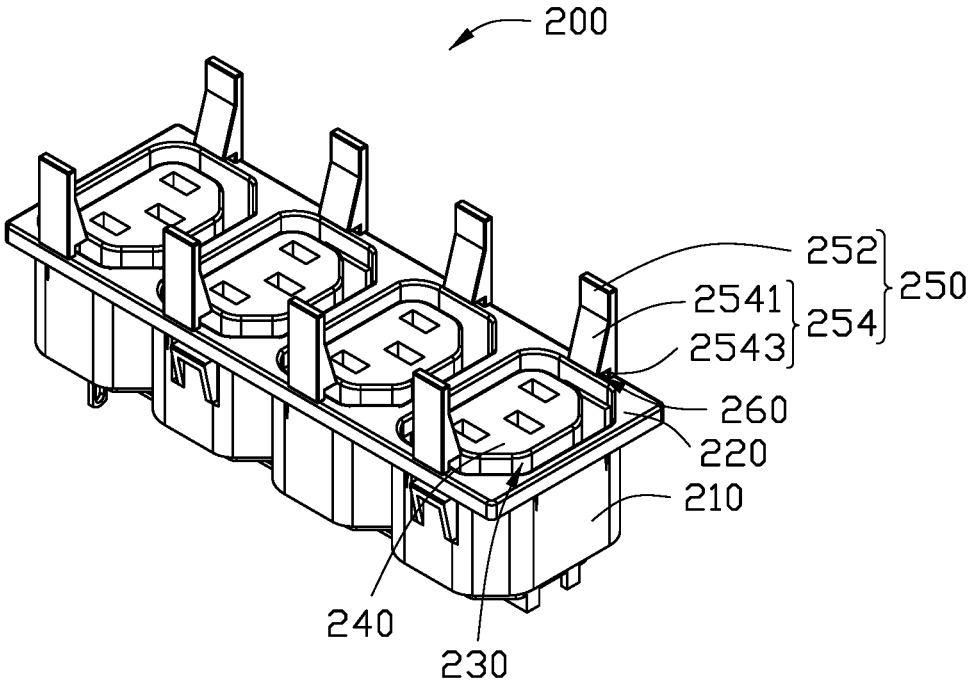
FIG. 3 is an isometric view of a socket of the connecting apparatus in FIG. 1
Figure 4:
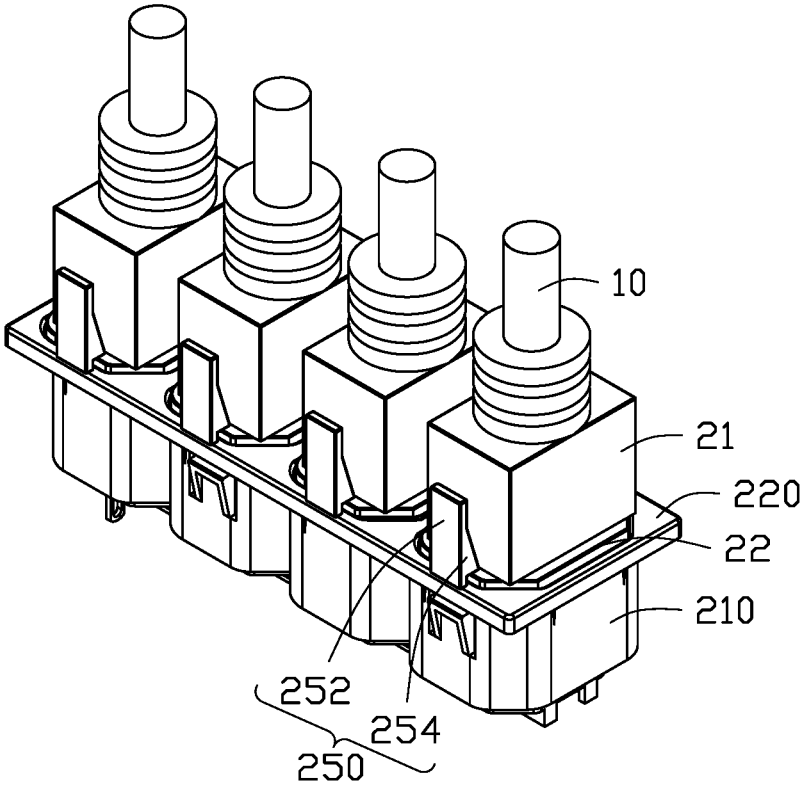
FIG. 4 is an isometric view of the connecting apparatus in FIG. 1.

FIG. 3 illustrates that the socket 200 includes a base 210 and a number of terminal portions 240. The base 210 defines a number of receiving grooves 230. The terminal portions 240 are fixed in the receiving grooves 230. The terminal portion 240 is configured to form an electrical connection with the plug 100. In the embodiment, the socket 200 includes four terminal portions 240. The base 210 defines four receiving grooves 230. Portions of the base 210 defining the receiving groove 230 has a corresponding shape as outer surfaces of connecting portion 22. An end of the connecting portion 22 away from the fixing portion 21 is pluggable into the receiving groove 230. A height of the connecting portion 22 is higher than a depth of the receiving groove 230.

The base 210 has an inserting side 220 where the receiving grooves 230 are defined, and two clamping members 250 protrude from two opposite edges s of the inserting side 220. When the connecting portion 22 is received in the receiving groove 230, the two clamping members 250 clamp the connoting portion 22. Thus, the connecting portion 22 is firmly received in the receiving groove 230. The clamping members 250 and the base 210 are molded integrally.

The clamping member 250 includes a clamping portion 254 and a contacting portion 252. The clamping portion 254 extends away from the inserting side 220, and the clamping portion 254 is substantially a trapezoid. The contacting portion 252 extends away from the clamping portion 254, and is perpendicular to the inserting side 220. The clamping portion 254 includes a sliding surface 2541 and a restricting surface 2543. The sliding surface 2541 obliquely connects to the contacting portion 252. The restricting surface 2543 connects the sliding surface 2541 to the contacting portion 252. An angle between the restricting surface 2543 and the sliding surface 2541 is an acute angle.

The restricting surface 2543 is parallel to the inserting surface 220. A clamping groove 260 is formed between the restricting surface 2543 and the inserting surface 220. A gap is formed between the clamping portion 254 and the inserting surface 220. Since the area of the cross section of the connecting portion 22 is larger than the area of a cross section of the fixing portion 21, when the connecting portion 22 plugs into the terminal portions 240, the clamping portion 254 can resiliently clamp onto the connecting portion 22.

The connecting portion 22 is plugged into the terminal portions 240 and a part of the connecting portion 22 is positioned above the receiving groove 230. The clamping portion 254 clamps onto the connecting portion 22 and the part of the connecting portion 22 above the receiving groove 230 is clamped in the clamping groove 260. The restricting surface 2543 abuts a side of the connecting portion 22 adjacent to the fixing portion 21. The fixing portion 21 is clamped by two clamping members 250. The plug 100 is thereby securely fixed to the socket 200.

The embodiments shown and described above are only examples. Even though numerous descriptions and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims.

What is claimed is:

1. A socket comprising:

a base comprising an inserting side, the inserting side defining a plurality of receiving grooves;

a plurality of terminal portions in the receiving grooves, each terminal portion configured to electrically connect to a plug;

a plurality of pairs of clamping members protruded from the inserting side, when a plug inserts into the terminal portion, one pair of the clamping members clamp the plug;

wherein the clamping member comprises a clamping portion and a contacting portion, the clamping portion extends away from the inserting side, and the clamping portion is substantially a trapezoid, the contacting portion extends away from the clamping portion, and is perpendicular to the inserting side, the clamping portion comprises a sliding surface and a restricting surface, the sliding surface obliquely connects to the contacting portion, the restricting surface connects the sliding surface to the contacting portion, an angle between the restricting surface and the sliding surface is an acute angle.

2. The socket of claim 1, wherein the restricting surface is parallel to the inserting surface, a clamping groove is formed between the restricting surface and the inserting surface.

3. The socket of claim 1, wherein the socket comprises four terminal portions, the base defines four receiving grooves.

4. A socket comprising:

a base defining a plurality of receiving grooves;

a plurality of terminal portions in the receiving grooves, the terminal portion configured to electrically connect to a plug;

two clamping members protruded from two opposite edges of the base surrounding each receiving groove, when the plug inserts into the terminal portion, two clamping members clamp the plug;

wherein the clamping member comprises a clamping portion and a contacting portion, the clamping portion extends away from the inserting side, and the clamping portion is substantially a trapezoid, the contacting portion extends away from the clamping portion, and is perpendicular to the inserting side, the clamping portion comprises a sliding surface and a restricting surface, the sliding surface obliquely connects to the contacting portion, the restricting surface connects the sliding surface to the contacting portion, an angle between the restricting surface and the sliding surface is an acute angle.

5. The socket of claim 4, wherein the restricting surface is parallel to the inserting surface, a clamping groove is formed between the restricting surface and the inserting surface.

6. The socket of claim 5, wherein the socket comprises four terminal portions, the base defines four receiving grooves.

7. A connecting apparatus comprising:

a socket comprising:

a base defining a plurality of receiving grooves;

a plurality of terminal portions fixed in the receiving grooves;

two clamping members protruded from an inserting side of the base adjacent to each receiving groove;

a plurality of plugs, each plus comprising:

a cable; and a main body connected to one end of the cable, the main body partly received in one of the receiving groove and inserted into the terminal portion to electrically connect to the terminal portion, and clamped is fixed between two clamping members;

wherein the main body comprises a fixing portion and a connecting portion, the connecting portion extends from an end of the fixing portion away from the cable, an extending direction of the connecting portion is same as an inserting direction of the plug inserting to the socket, an area of a cross section of the connecting portion perpendicular to the extending direction has an area is larger than an area of a cross section of the fixing portion perpendicular to the extending direction, the clamping member comprises a clamping portion and a contacting portion, the clamping portion extends away from the inserting side, and the clamping portion is substantially a trapezoid, the contacting portion extends away from the clamping portion, and is perpendicular to the inserting side, the clamping portion comprises a sliding surface and a restricting surface, the sliding surface obliquely connects to the contacting portion, the restricting surface connects the sliding surface to the contacting portion, an angle between the restricting surface and the sliding surface is an acute angle.

8. The connecting apparatus of claim 7, wherein the restricting surface is parallel to the inserting surface, a clamping groove is formed between the restricting surface and the inserting surface.

9. The connecting apparatus of claim 7, wherein the socket comprises four terminal portions, the base defines four receiving grooves.

* * * * *